US006601520B2

(12) United States Patent
Eche et al.

(10) Patent No.: US 6,601,520 B2
(45) Date of Patent: Aug. 5, 2003

(54) MOTOR BOGIE FOR A VEHICLE HAVING AN INTEGRAL LOW-SLUNG FLOOR

(75) Inventors: Christophe Eche, Le Creusot (FR); Jean-Christophe Loiseau, Le Creusot (FR); Alain Rodet, Le Creusot (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/175,457

(22) Filed: Jun. 20, 2002

(65) Prior Publication Data

US 2002/0195018 A1 Dec. 26, 2002

(30) Foreign Application Priority Data

Jun. 26, 2001 (FR) ..... 01 08 425

(51) Int. Cl.[7] ..... B61C 11/00

(52) U.S. Cl. ..... 105/34.1; 105/96.1; 105/133; 105/158.2; 105/182.1; 105/218.1

(58) Field of Search ..... 105/34.1, 96, 96.1, 105/120, 122, 132, 133, 135, 140, 158.2, 172, 178, 182.1, 218.1

(56) References Cited

U.S. PATENT DOCUMENTS

| | | | | | |
|---|---|---|---|---|---|
| 452,035 | A | * | 5/1891 | Short | 105/56 |
| 1,880,953 | A | * | 10/1932 | Fageol | 105/4.4 |
| 4,130,065 | A | * | 12/1978 | Susdorf et al. | 105/135 |
| 4,135,456 | A | * | 1/1979 | Welsh | 105/135 |
| 4,648,326 | A | * | 3/1987 | Jackson | 105/168 |
| 5,119,736 | A | * | 6/1992 | Chiodi | 105/158.2 |
| 5,181,473 | A | * | 1/1993 | Petit et al. | 105/133 |
| 5,277,127 | A | * | 1/1994 | Euwijk et al. | 105/176 |
| 6,267,062 | B1 | * | 7/2001 | Hamilton, Jr. | 105/26.05 |

FOREIGN PATENT DOCUMENTS

| | | |
|---|---|---|
| DE | 29 10 392 | 9/1980 |
| DE | 44 19 362 | 12/1995 |
| EP | 0 678 435 | 10/1995 |
| WO | WO 96 29224 | 9/1996 |
| WO | WO 98 24674 | 6/1998 |

* cited by examiner

*Primary Examiner*—Mark T. Le
(74) *Attorney, Agent, or Firm*—Sughrue Mion, PLLC

(57) ABSTRACT

A motor bogie for a rail vehicle having an integral low-slung floor, the motor bogie having a frame resting on four wheels via a primary suspension, the frame supporting at least one motor disposed on one side of the frame and connected to at least one wheel via transmission, wherein each wheel has an individual wheel shaft supported by an axle box, and wherein the transmission comprise a gear unit coupled directly to the shaft of the wheel and a telescopic transmission of the type having a double universal joint and disposed between the gear unit and the motor, the gear unit being placed outside the wheel, and having a casing incorporating the axle box of the shaft of the wheel, the casing of the gear unit serving as a support element for supporting a primary suspension member on which the frame bears.

7 Claims, 2 Drawing Sheets

MOTOR BOGIE FOR A VEHICLE HAVING AN INTEGRAL LOW-SLUNG FLOOR

The invention relates to a motor bogie for a rail vehicle having an integral low-slung floor, and more particularly to a bogie having a frame resting on four wheels via a primary suspension, the frame supporting at least one motor disposed on one side of the frame and connected to at least one wheel via transmission means.

The invention is suitable in particular for trams in which a low-slung floor facilitates access (both when boarding and when alighting) for children, old people, and the disabled.

BACKGROUND OF THE INVENTION

The Applicant's Patent Application FR 2 637 861 discloses a motor bogie for a rail vehicle having a low-slung floor. That bogie has a frame resting on two axles via a primary suspension, the frame supporting traction motors disposed on the sides of the bogie and connected to the wheels via transmission means disposed outside the wheels. Unfortunately, such a bogie suffers from the drawback of having axles and axle boxes that occupy the space between the wheels, and thus make it necessary to dispose the floor above the axles.

Document EP-B1-0 698 540 discloses a motor bogie for a rail vehicle having a low-slung floor. That bogie has a frame resting on four wheels mounted individually, without being coupled together via axle shafts, and supporting two motors disposed on the sides of the bogie. Each motor has two outlet shafts connected directly to respective gear units disposed outside the wheels and connected to respective ones of the wheels via respective couplings of the hollow shaft type, allowing the wheels to be displaced vertically. Such a bogie offers the advantage of not having any axle shaft links between the individual wheels, thereby making it possible to lower the floor further, but unfortunately, it suffers from the drawback of including wheel shafts that are guided by axle boxes disposed on the insides of the wheels, thereby occupying the space between the insides of the wheels and limiting the width available for the floor at the bogies.

Such a bogie also suffers from the drawback of including braking members which are associated with the gearing and which are thus specific to a motor bogie, and the rail vehicle thus has braking members that are different on the motor bogies than on carrying bogies, thereby complicating maintenance operations.

OBJECTS AND SUMMARY OF THE INVENTION

An object of the present invention is thus to remedy the various drawbacks by proposing a motor bogie for a rail vehicle having an integral low-slung floor that makes it possible to have a floor at the bogie that extends at very low height over a width close to the spacing between the wheels. Another object of the present invention is to propose a motor bogie for a rail vehicle that has braking members that are easily accessible and that can be fitted interchangeably both to carrying bogies and to motor bogies.

The invention provides a motor bogie for a rail vehicle having an integral low-slung floor, the motor bogie having a frame resting on four wheels via a primary suspension, said frame supporting at least one motor disposed on one side of the frame and connected to at least one wheel via transmission means, wherein each wheel has an individual wheel shaft supported by an axle box, and wherein said transmission means comprise a gear unit coupled directly to the shaft of said wheel and a telescopic transmission of the type having a double universal joint and disposed between the gear unit and the motor, said gear unit being placed outside the wheel, and having a casing incorporating the axle box of the shaft of the wheel, said casing of the gear unit also serving as a support element for supporting a primary suspension member on which the frame bears.

In particular embodiments, the motor bogie of the invention may include one or more of the following characteristics taken in isolation or in any technically-feasible combination:

- two motors are fixed to the frame and disposed longitudinally on either side of the frame, each motor driving the two wheels disposed one behind the other on the side of the frame, by means of a telescopic transmission of the type having a double universal joint and placed between the motor and a gear unit coupled directly to the shaft of the wheel; each gear unit having a casing incorporating the axle box of the wheel, and serving as a support element for supporting a primary suspension member;
- at least one wheel has a shaft passing through the casing of the gear unit towards the outside of the bogie, said shaft of the wheel being secured to a brake disk mounted outside the gear unit;
- each side of the bogie has a wheel provided with a shaft passing through the casing of the gear unit and secured to a brake disk, said brake disk being mounted outside the gear unit and on the outside of the wheel;
- each of said motors has a single rotor equipped with two outlet shafts leading respectively to two opposite faces;
- said members of the primary suspension are constituted by a sandwich of metal plates and of elastomer material, and they are interposed between abutment surfaces of the outside faces of the casing of the gear units and abutment surfaces of the frame; and
- said frame is made up of two longitudinal sole-bars disposed outside the wheels and connected together via cross-members, each of which has a low central portion extending below the level of the axes of the wheels.

BRIEF DESCRIPTION OF THE DRAWINGS

The objects, features, and advantages of the present invention are better understood from the following description of a particular embodiment of the invention, given by way of non-limiting example, and with reference to the accompanying drawings, in which.

MORE DETAILED DESCRIPTION

To make the drawings more legible, only those elements which are necessary to understand the invention are shown. Like elements are given like references from one figure to the other.

Figure 1:
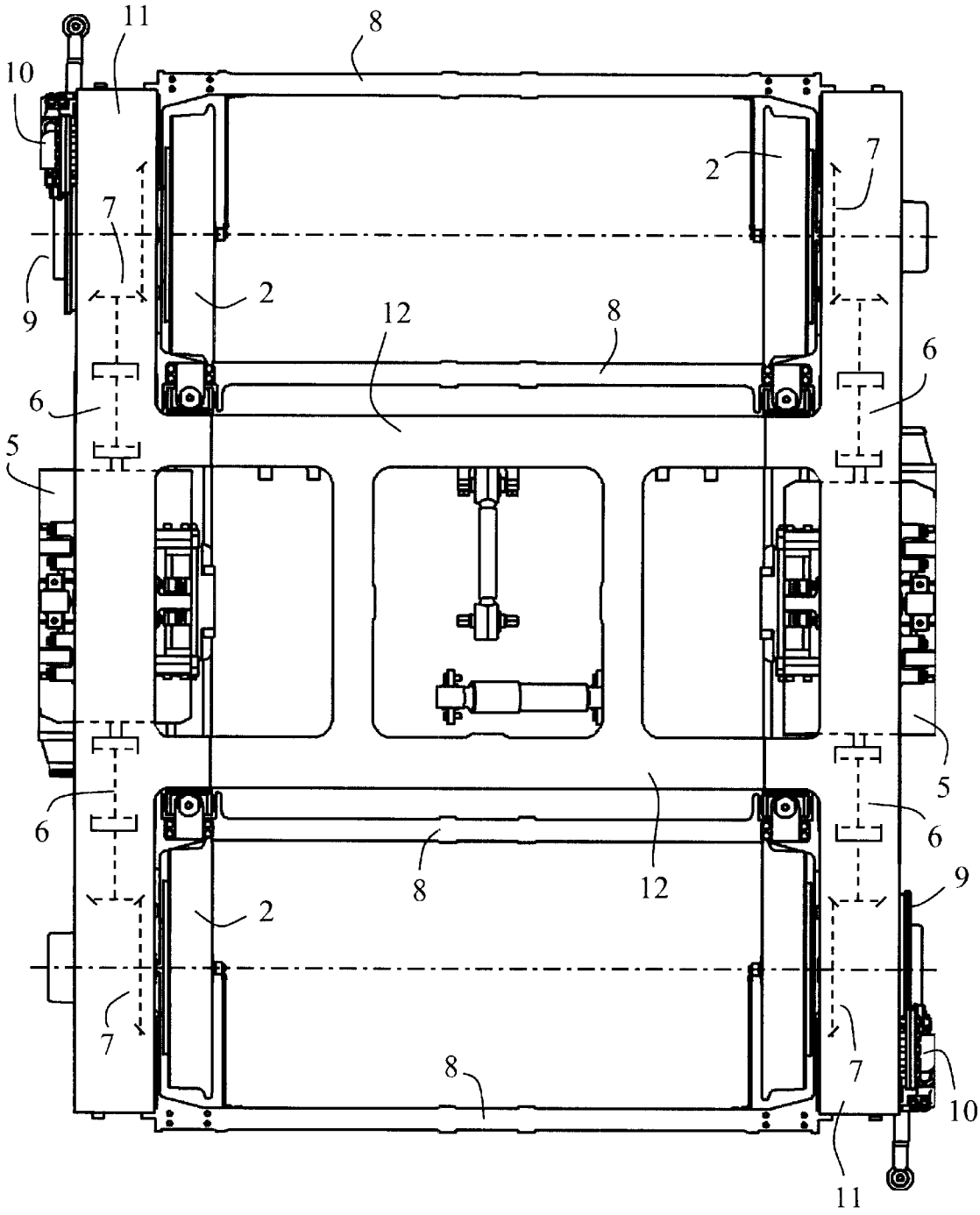
FIG. 1 is a plan view of a motor bogie for a rail vehicle having a low-slung floor, in a particular embodiment of the invention.
Figure 2:
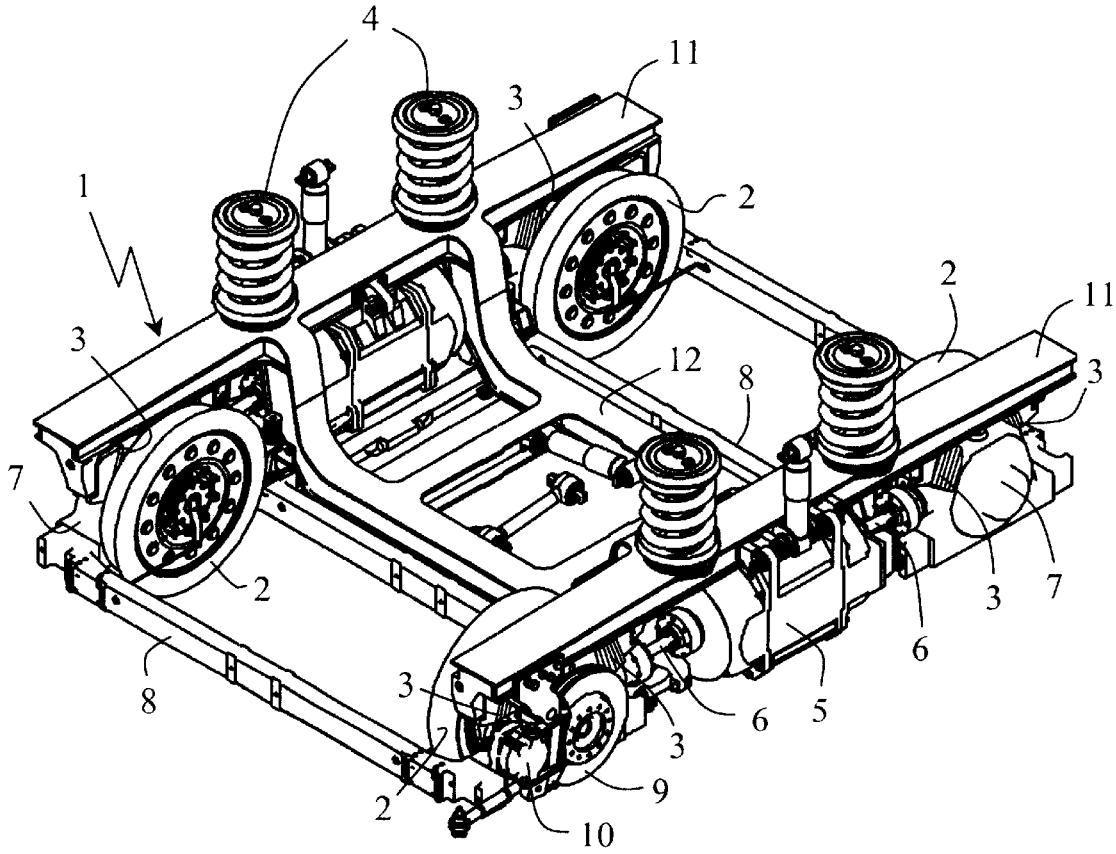
FIG. 2 is a perspective view of the motor bogie of FIG. 1.

FIGS. 1 and 2 show a tram bogie having a frame 1 resting on four wheels 2 via a primary suspension 3 allowing vertical displacement of about ±15 mm. The four wheels 2 are distributed conventionally over two sets of wheels, each set serving to come onto a respective rail of the track, each of the wheels 2 having an individual wheel shaft mounted on an axle box and the wheels not being interconnected via axle shafts.

As shown in FIG. 2, the frame 1 comprises a structure made up mainly of two longitudinal sole-bars 11 interconnected via two cross-members 12, the longitudinal sole-bars 11 being disposed outside the wheels 2 and extending at a height higher than the axes of the wheels 2. The cross-members 12 extend perpendicularly to the longitudinal sole-bars 11, and each of them has a low central portion disposed inside the zone defined by the four wheels 2, extending at a height lower than the axes of the wheels 2, and making it possible to vacate as much space as possible between the wheels 2 for receiving a floor.

The top faces of the longitudinal sole-bars 11 support secondary suspension members 4 serving to receive the body of the tram via a load-bearing cross-beam (not shown).

Each longitudinal sole-bar 11 also supports a traction motor 5 which is disposed under and to one side of the sole-bar 11 so that the axis of the motor 5 lies outside the longitudinal plane of the two wheels 2 of the set of wheels. Each of the motors 5 comprises a rotor provided with two outlet shafts, each of the outlet shafts being connected to the nearer wheel 2 via a telescopic transmission 6 having a double universal joint, itself connected to a bevel-gear gear unit 7 mounted directly on the shaft of the wheel 2.

Each gear unit 7 is mounted to the outside of the plane of the wheel 2, and includes a casing incorporating the axle box of the wheel 2, the casing of the gear unit 7 also serving as a support element for supporting two members of the primary suspension 3 which is of known type, in the form a sandwich of metal plates and of elastomer material, as shown in FIG. 2.

Secondary cross-members 8 interconnect the casings of the gear units 7 of the two sets of wheels, these cross-members 8 being disposed on either side of each wheel 2, at a height substantially identical to the height of the low central portion of the cross-members 12 of the frame 1. These secondary cross-members 8 maintain the spacing and the parallelism between the wheels 2 of the two sets of wheels.

Each set of wheels has a wheel 2 having a wheel shaft that passes through the casing of the gear unit 7 and that has an end secured to a brake disk 9 which co-operates with a brake caliper 10 fixed to the longitudinal sole-bar 11 and to the casing of the gear unit 7. These brake members, constituted by the disk 9 and by the caliper 10, make it possible to brake both of the wheels 2 in the set of wheels, these wheels being coupled together mechanically via the common rotor of the traction motor 5.

By incorporating the axle boxes in the casings of the gear units, and by using said casings as abutment elements for the members of the primary suspension, the above-described motor bogie offers the advantage of having space between the wheels that is totally vacant down to the height of the low cross-members of the frame, thereby making it possible to implement a low-slung floor which, at the bogies, has a width close to the spacing between the wheels.

In addition, by incorporating the axle boxes into the casings of the gear units, it is possible not only to obtain greater compactness and a saving in weight, but also to vacate space for installing braking members outside the wheels, which members then have the advantage of offering easy maintenance. Such a braking installation also makes it possible to use brake disks and brake calipers that are identical to those of the bogies that are merely load-bearing bogies of the rail vehicle, thereby making it possible to standardize the braking members between motor bogies and carrying bogies, and thus to reduce the manufacturing and maintenance costs for the braking members of the rail vehicle.

Finally, installing a gear unit coupled directly to the wheel and connected to the motor via a telescopic transmission offers the advantage of generating lower torque at the telescopic transmission compared with the torque transmitted by the gear unit to the wheel, thereby making it possible to have telescopic transmissions that are compact.

Naturally, the invention is not limited to the embodiment described and shown which is given merely by way of example. Modifications remain possible, in particular as regards how the various elements are constituted, or by using equivalent techniques by way of substitutes, without going beyond the scope of protection of the invention.

Thus, in a variant embodiment (not shown), the traction motor having a double outlet shaft for each set of wheels may be replaced by a traction motor having two mechanically-independent rotors disposed one behind the other, or by two traction motors. In which case, each wheel shaft may, for example, be equipped with a brake disk in order to perform the braking on all four wheels.

What is claimed is:

1. A motor bogie for a rail vehicle having an integral low-slung floor, the motor bogie having a frame resting on four wheels via a primary suspension, said frame supporting at least one motor disposed on one side of the frame and connected to at least one wheel via transmission means, wherein each wheel has an individual wheel shaft supported by an axle box, and wherein said transmission means comprise a gear unit coupled directly to the shaft of said wheel and a telescopic transmission having a double universal joint and disposed between the gear unit and the motor, said gear unit being placed outside the wheel, and having a casing incorporating the axle box of the shaft of the wheel, said casing of the gear unit serving as a support element for supporting a member of the primary suspension on which the frame bears.

2. A motor bogie according to claim 1, having two motors fixed to the frame and disposed longitudinally on either side of the frame, each motor driving the two wheels disposed one behind the other on the side of the frame, by means of a telescopic transmission having a double universal joint and placed between the motor and a gear unit coupled directly to the shaft of the wheel; each gear unit having a casing incorporating the axle box of the wheel, and serving as a support element for supporting a primary suspension member.

3. A motor bogie according to claim 1, wherein at least one wheel has a shaft passing through the casing of the gear unit towards the outside of the bogie, said shaft of the wheel being secured to a brake disk mounted outside the gear unit.

4. A motor bogie according to claim 2, wherein each side of the bogie has a wheel provided with a shaft passing through the casing of the gear unit and secured to a brake disk, said brake disk being mounted outside the gear unit and on the outside of the wheel.

5. A motor bogie according to claim 1, wherein each of said motors has a single rotor equipped with two outlet shafts leading respectively to two opposite faces.

6. A motor bogie according to claim 1, wherein said members of the primary suspension are constituted by a sandwich of metal plates and of elastomer material, and they are interposed between abutment surfaces of the outside faces of the casing of the gear units and abutment surfaces of the frame.

7. A motor bogie according to claim 1, wherein said frame is made up of two longitudinal sole-bars disposed outside the wheels and connected together via cross-members, each of which has a low central portion extending below the level of the axes of the wheels.

* * * * *